US007073486B2

(12) United States Patent
Nomura et al.

(10) Patent No.: US 7,073,486 B2
(45) Date of Patent: Jul. 11, 2006

(54) FUEL PRESSURE CONTROL DEVICE OF INTERNAL COMBUSTION ENGINE

(75) Inventors: Mitsuhiro Nomura, Toyota (JP); Yasumichi Inoue, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/166,272

(22) Filed: Jun. 27, 2005

(65) Prior Publication Data

US 2006/0027213 A1 Feb. 9, 2006

(30) Foreign Application Priority Data

Aug. 4, 2004 (JP) ..... 2004-227915

(51) Int. Cl.
*F02M 37/00* (2006.01)

(52) U.S. Cl. ..... 123/446; 123/467

(58) Field of Classification Search ..... 123/494, 123/446, 456, 357, 467, 198 D; 73/118.1, 73/119 A, 116
See application file for complete search history.

(56) References Cited

U.S. PATENT DOCUMENTS 5,404,855 A * 4/1995 Yen et al. ..... 123/446
5,609,136 A * 3/1997 Tuken ..... 123/357
5,653,210 A 8/1997 Fischer et al.
5,678,521 A * 10/1997 Thompson et al. ..... 123/447
5,697,343 A * 12/1997 Isozumi et al. ..... 123/446
6,095,118 A * 8/2000 Klinger et al. ..... 123/446
6,539,922 B1 * 4/2003 Sakai et al. ..... 123/458
6,840,220 B1 * 1/2005 Yomogida et al. ..... 123/456
6,840,228 B1 * 1/2005 Yomogida et al. ..... 123/494
6,899,084 B1 * 5/2005 Miyashita ..... 123/446

FOREIGN PATENT DOCUMENTS

| | | |
|---|---|---|
| DE | 197 52 025 A 1 | 7/1999 |
| EP | 1 136 686 A2 | 9/2001 |
| GB | 2 331 597 A | 5/1999 |
| JP | 11-044276 A | 2/1999 |
| JP | 2001-263144 A | 9/2001 |
| JP | 2002-213326 A | 7/2002 |
| JP | 2002-295337 A | 10/2002 |

* cited by examiner

*Primary Examiner*—Carl S. Miller
(74) *Attorney, Agent, or Firm*—Oliff & Berridge, PLLC

(57) ABSTRACT

An engine ECU executes a program including the steps of, when it is necessary to calculate an integral term, employing an integral term for use when two pumps are operating for calculation of a duty when the number of operating pumps is 2 and storing the calculated integral term in a memory as the one for use in the case of two pumps operating, and employing an integral term for use when one pump is operating for calculation of a duty when the number of operating pumps is not 2 and storing the calculated integral term in the memory as the one for use in the case of one pump operating.

4 Claims, 4 Drawing Sheets

FUEL PRESSURE CONTROL DEVICE OF INTERNAL COMBUSTION ENGINE

This nonprovisional application is based on Japanese Patent Application No. 2004-227915 filed with the Japan Patent Office on Aug. 4, 2004, the entire contents of which are hereby incorporated by reference.

BACKGROUND OF THE INVENTION

1. Field of the Invention

The present invention relates to a control device of a high-pressure fuel system of an internal combustion engine that includes fuel injection means (in-cylinder injector) for injecting a fuel into a cylinder at a high pressure, or an internal combustion engine that includes, in addition to the above fuel injection means, fuel injection means (intake manifold injector) for injecting a fuel into an intake manifold or an intake port. More particularly, the present invention relates to a technique for controlling a high-pressure fuel system having a plurality of high-pressure fuel pumps.

2. Description of the Background Art

An engine having a first fuel injection valve (in-cylinder injector) for injecting a fuel into a combustion chamber of a gasoline engine and a second fuel injection valve (intake manifold injector) for injecting a fuel into an intake manifold, and changing a fuel injection ratio between the in-cylinder injector and the intake manifold injector in accordance with the engine speed or the load of the internal combustion engine is known. A direct injection engine having only a fuel injection valve (in-cylinder injector) for injecting a fuel into a combustion chamber of a gasoline engine is also known. In a high-pressure fuel system including the in-cylinder injector, the fuel having its pressure increased by a high-pressure fuel pump is supplied via a delivery pipe to the in-cylinder injector, which injects the high-pressure fuel into a combustion chamber of each cylinder of the internal combustion engine.

Further, a diesel engine having a common rail fuel injection system is also known. In the common rail fuel injection system, the fuel having its pressure increased by a high-pressure fuel pump is stored in a common rail, and injected from the common rail into a combustion chamber of each cylinder of the diesel engine according to opening/closing of an electromagnetic valve.

To obtain the fuel of a high pressure in such internal combustion engines, a high-pressure fuel pump is used which has a cylinder driven by a cam provided at a driveshaft that is connected to a crankshaft of the internal combustion engine.

Japanese Patent Laying-Open No. 11-044276 discloses a fuel injection apparatus that reduces fluctuation of fuel pressure in common rails due to discharge pulsation of high-pressure pumps so as to stabilize the amount of the fuel injected. The fuel injection apparatus includes first and second high-pressure pipes having their proximal ends connected to a fuel tank, first and second high-pressure pumps provided at certain positions on the first and second high-pressure pipes, respectively, and driven at timings to cancel the discharge pulsation with each other, first and second common rails formed in tubular bodies provided with injection valves and connected to the tip ends of the first and second high-pressure pipes, respectively, to inject the fuel discharged from the first and second high-pressure pumps into the engine, and a connection pipe arranged between the discharge sides of the first and second high-pressure pumps and the first and second common rails so as to connect the first and second high-pressure pipes.

According to this fuel injection apparatus, the discharge pulsation of the fuel caused by the first and second high-pressure pumps would interfere one another through the connection pipe. At this time, the first and second high-pressure pumps are driven at timings to cancel the discharge pulsation with each other. For example, when the first high-pressure pump is in a discharge stroke, the second high-pressure pump is in an intake stroke. Thus, the peak of discharge pulsation by the first high-pressure pump and the trough of discharge pulsation by the second high-pressure pump can cancel each other. As such, the fuel with reduced pulsation can be supplied from the first and second high-pressure pipes toward the first and second common rails, so that fluctuation in fuel pressure in each of the common rails can be suppressed.

Japanese Patent Laying-Open No. 2001-263144 discloses a fuel pressure control apparatus for an internal combustion engine capable of suppressing excessive increase of an actual fuel pressure exceeding its target value due to erroneous excessive increase of an integral term when the amount of the fuel discharged from a fuel pump is approximate to or equal to its maximum value. This fuel pressure control apparatus for an internal combustion engine has a fuel pump for discharging a fuel into a fuel pipe, and controls in a feedback manner the amount of the fuel discharged from the fuel pump based on an actual fuel pressure within the fuel pipe and its target value such that the actual fuel pressure approaches the target value. The control apparatus includes means for calculating a controlled variable for use in the feedback control of the amount of the fuel discharged from the fuel pump based on the integral term updated in accordance with a difference between the actual fuel pressure and its target value, and means for inhibiting the update of the integral term toward the increase side in which the amount of the fuel discharged from the fuel pump is increased, when the amount of the fuel discharged is approximate to or equal to the maximum value thereof.

When the amount of the fuel discharged from the fuel pump is approximate or equal to the maximum value at the start of the engine or the like, even if the integral term is updated so as to increase the fuel pressure to a target value, the fuel pressure will not increase rapidly. As such, the integral term may erroneously be changed to the side to excessively increase the amount of the fuel discharged. In contrast, according to the above-described configuration of the fuel pressure control apparatus for an internal combustion engine, update of the integral term toward the side causing increase in amount of the fuel discharged is inhibited when the amount of the fuel discharged from the fuel pump is approximate or equal to its maximum value. Accordingly, it is possible to suppress occurrence of so-called overshoot, which is a considerable rise of the actual fuel pressure exceeding the target value, due to the change of the integral term toward the side causing excessive increase of the amount of the fuel discharged, when the amount of the fuel discharged from the fuel pump is approximate or equal to the maximum value.

However, although the fuel injection device disclosed in Japanese Patent Laying-Open No. 11-044276 has two high-pressure fuel pumps connected to each other via a connection pipe, there is no disclosure of detailed control of the high-pressure fuel pumps. The fuel pressure control apparatus for an internal combustion engine disclosed in Japanese Patent Laying-Open No. 2001-263144 does feedback control of only one high-pressure fuel pump.

When two or more high-pressure fuel pumps are connected via a connection pipe to supply a high-pressure fuel into one high-pressure fuel system, the high-pressure fuel pumps are controlled in a feedback manner. At this time, control duties of the high-pressure fuel pumps are changed to control the amounts of the fuel discharged therefrom, so as to attain a desired fuel pressure. In such a case, if the controlled variable (especially, integral term) used for the feedback control is fixed regardless of change in number of operating high-pressure fuel pumps, good controllability of the fuel pressure before and after the switching in number of the operating high-pressure fuel pumps cannot be expected due to the difference between the individual high-pressure fuel pumps.

SUMMARY OF THE INVENTION

The present invention has been made to solve the above-described problems. An object of the present invention is to provide a fuel pressure control device of an internal combustion engine that can realize good controllability of fuel pressure when a plurality of high-pressure fuel pumps form a high-pressure fuel system and the number of operating high-pressure fuel pumps is changed as necessary.

According to the present invention, a fuel pressure control device of an internal combustion engine having at least two fuel pumps discharging a fuel into a fuel pipe controls amounts of the fuel discharged from the fuel pumps in a feedback manner based on an actual fuel pressure in the fuel pipe and a target value thereof such that the actual fuel pressure approaches the target value. The fuel pressure control device includes: a calculating unit for calculating a controlled variable used for the feedback control of the amounts of the fuel discharged from the fuel pumps based on an integral term that is updated in accordance with a difference between the actual fuel pressure and the target value thereof; and a changing unit for changing setting of the integral term based on the number of operating pumps among the fuel pumps.

According to this invention, the integral term for use in the feedback control of the fuel pressure is changed in accordance with the number of fuel pumps actually activated. As a proper integral term corresponding to the number of operating pumps can be chosen as appropriate, variation in fuel pressure due to the individual difference of the fuel pumps or leakage therefrom can be suppressed, so that good controllability eliminating the steady-state error is realized. As a result, it is possible to provide a fuel pressure control device of an internal combustion engine that can realize good controllability of fuel pressure when a plurality of high-pressure fuel pumps form a high-pressure fuel system and the number of high-pressure fuel pumps activated is changed as necessary.

According to another aspect of the present invention, a fuel pressure control device of an internal combustion engine having a first fuel pump and a second fuel pump each discharging a fuel into a fuel pipe controls an amount of the fuel discharged from the first fuel pump and an amount of the fuel discharged from the second fuel pump in a feedback manner based on an actual fuel pressure in the fuel pipe and a target value thereof such that the actual fuel pressure approaches the target value. The fuel pressure control device includes: a calculating unit for calculating a controlled variable used for the feedback control of the amounts of the fuel discharged from the fuel pumps based on an integral term that is updated in accordance with a difference between the actual fuel pressure and the target value thereof; and a changing unit for changing setting of the integral term between the case where one of the first and second fuel pumps is operating and the case where both of the first and second fuel pumps are operating.

According to this invention, the integral term for use in the feedback control of the fuel pressure is changed according to whether one or two fuel pumps are actually activated. Therefore, an integral term that is suitable for the case where one fuel pump is operating or an integral term that is suitable for the case where two fuel pumps are operating can be chosen appropriately, and variation in fuel pressure due to the individual difference between the two fuel pumps or leakage therefrom is suppressed, and thus, good controllability that can eliminate the steady-state error is realized. As a result, it is possible to provide a fuel pressure control device of an internal combustion engine that can ensure good controllability of fuel pressure when two high-pressure fuel pumps form a high-pressure fuel system and the number of high-pressure fuel pumps activated is switched between one and two as necessary.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
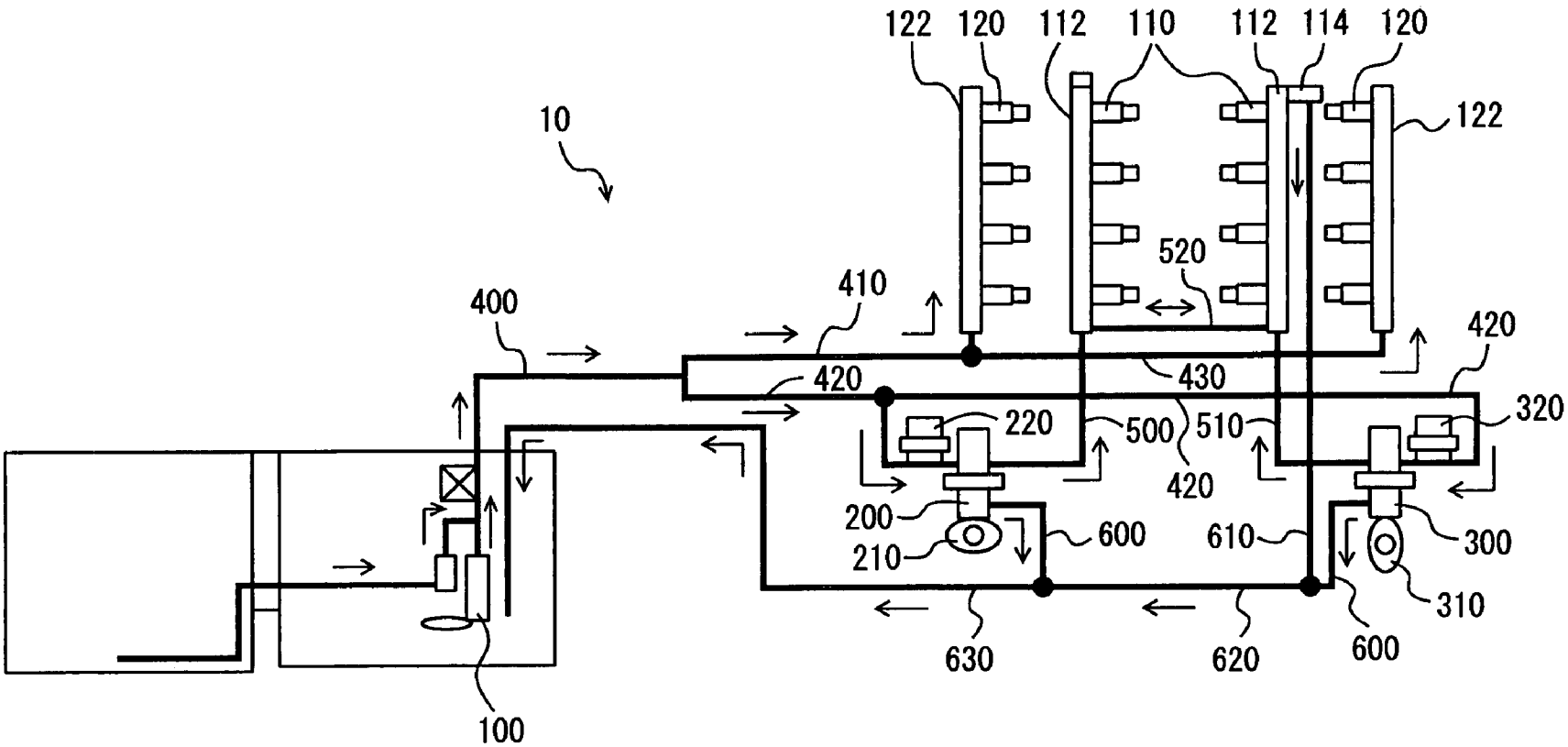
FIG. 1 is an overall schematic view of a fuel supply system of a gasoline engine controlled by a control device according to an embodiment of the present invention.

Hereinafter, embodiments of the present invention will be described with reference to the drawings. In the following description, the same reference characters denote the same portions having the same names and functions. Thus, detailed description thereof will not be repeated.

FIG. 1 shows a fuel supply system 10 of an engine controlled by an engine ECU (Electronic Control Unit) that is a control device according to an embodiment of the present invention. The engine is a V-type 8-cylinder gasoline engine, and has in-cylinder injectors 110 for injecting the fuel into the respective cylinders, and intake manifold injectors 120 for injecting the fuel into intake manifolds of the respective cylinders. It is noted that the present invention is not applied exclusively to such an engine, but is also applicable to a gasoline engine of another type and a common rail diesel engine. Further, the number of high-pressure fuel pumps is not restricted to two, but may be any number of more than one.

As shown in FIG. 1, this fuel supply system 10 includes a feed pump 100 provided in a fuel tank and for supplying a fuel at a discharge pressure of low pressure (about 400 kPa corresponding to the pressure of a pressure regulator), a first high-pressure fuel pump 200 driven by a first cam 210, a second high-pressure fuel pump 300 driven by a second cam 310 having a discharge phase different from that of first cam 210, a high-pressure delivery pipe 112 provided for each of left and right banks and for supplying a high-pressure fuel to in-cylinder injectors 110, four in-cylinder injectors 110 for each of the left and right banks, provided at the corresponding high-pressure delivery pipe 112, a low-pressure delivery pipe 122 provided for each of the left and right banks and for supplying a fuel to intake manifold injectors 120, and four intake manifold injectors 120 for each of the left and right banks, provided at the corresponding low-pressure delivery pipe 122.

The discharge port of feed pump 100 in the fuel tank is connected to a low-pressure supply pipe 400, which is branched into a first low-pressure delivery connection pipe 410 and a pump supply pipe 420. First low-pressure delivery connection pipe 410 is branched to low-pressure delivery pipe 122 of one of the V-shaped banks, and on the downstream of that branch point, it forms a second low-pressure delivery connection pipe 430, which is connected to low-pressure delivery pipe 122 of the other bank.

Pump supply pipe 420 is connected to intake ports of first and second high-pressure fuel pumps 200 and 300. A first pulsation damper 220 and a second pulsation damper 320 are provided immediately upstream of the intake ports of first and second high-pressure fuel pumps 200 and 300, respectively, so as to reduce fuel pulsation.

The discharge port of first high-pressure fuel pump 200 is connected to a first high-pressure delivery connection pipe 500, which is connected to high-pressure delivery pipe 112 of one of the V-shaped banks. The discharge port of second high-pressure fuel pump 300 is connected to a second high-pressure delivery connection pipe 510, which is connected to high-pressure delivery pipe 112 of the other bank. High-pressure delivery pipe 112 of one bank and high-pressure delivery pipe 112 of the other bank are connected via a high-pressure connection pipe 520.

A relief valve 114 provided at high-pressure delivery pipe 112 is connected via a high-pressure delivery return pipe 610 to a high-pressure fuel pump return pipe 600. The return ports of high-pressure fuel pumps 200 and 300 are connected to high-pressure fuel pump return pipe 600. High-pressure fuel pump return pipe 600 is connected to return pipes 620 and 630, and then connected to the fuel tank.

Figure 2:
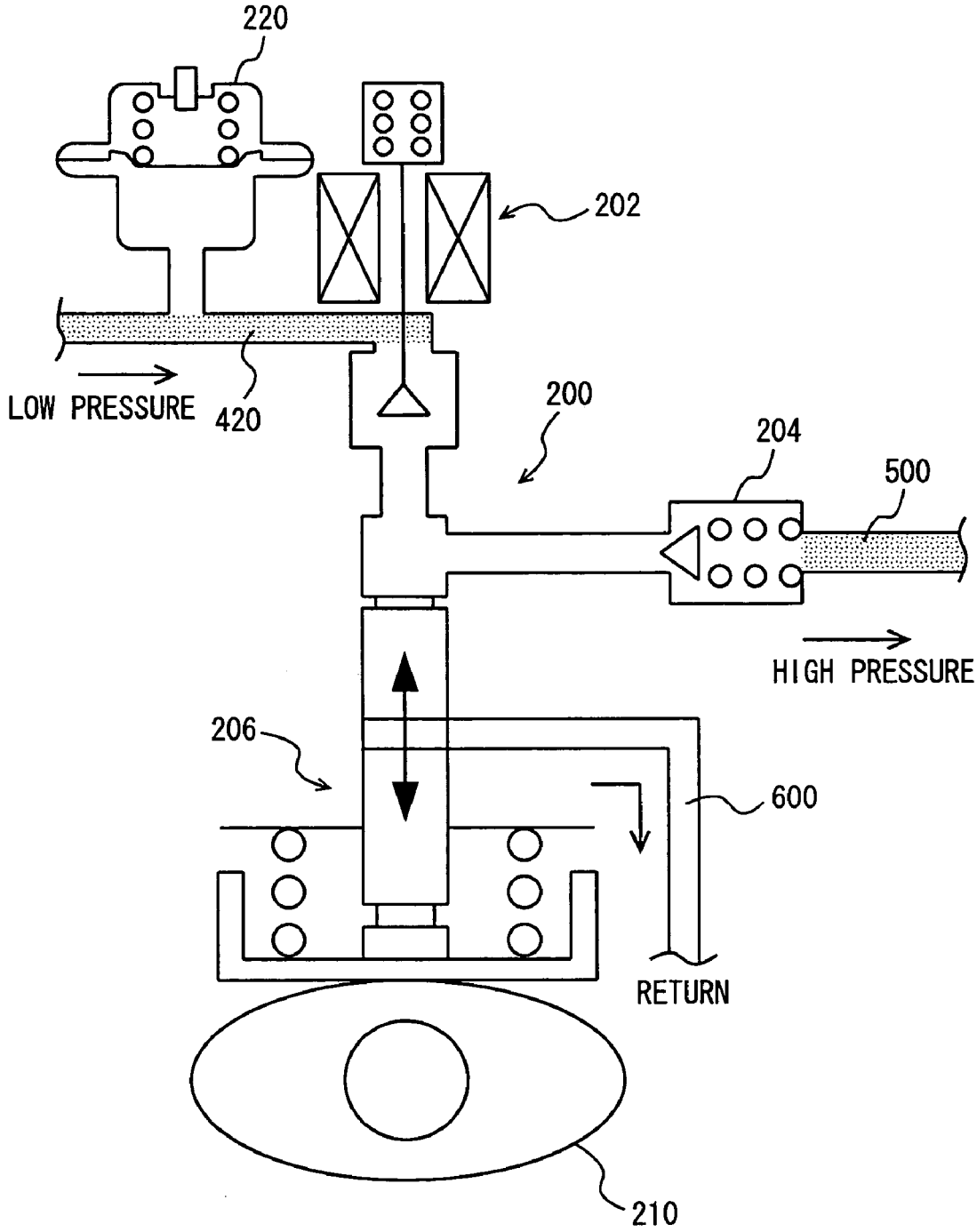
FIG. 2 is a partial enlarged view of FIG. 1.

FIG. 2 is an enlarged view of first high-pressure fuel pump 200 and its surroundings in FIG. 1. Although second high-pressure fuel pump 300 has the similar configuration, they are different in phase of the cams and hence different in phase of the discharge timings, thereby suppressing occurrence of pulsation. First and second high-pressure fuel pumps 200 and 300 may have characteristics similar to or different from each other. In the following explanation, it is assumed that first and second high-pressure fuel pumps 200 and 300 are the same in discharge capability in specification, but different in controllability due to individual difference thereof.

High-pressure fuel pump 200 has, as its main components, a pump plunger 206 driven by a cam 210 to slide up and down, an electromagnetic spill valve 202, and a check valve 204 provided with a leakage function.

When pump plunger 206 is moved downward by cam 210 and while electromagnetic spill valve 202 is open, the fuel is introduced (suctioned). When pump plunger 206 is moved upward by cam 210, the timing to close electromagnetic spill valve 202 is changed to control the amount of the fuel discharged from high-pressure fuel pump 200. During the pressurizing stroke in which pump plunger 206 is moved upward, the fuel of a greater amount is discharged as the timing to close electromagnetic spill valve 202 is earlier, whereas the fuel of a fewer amount is discharged as the timing to close the valve is later. The drive duty of electromagnetic spill valve 202 when the greatest amount of fuel is discharged is set to 100%, and the drive duty of electromagnetic spill valve 202 when the smallest amount of fuel is discharged is set to 0%. When the drive duty is 0%, electromagnetic spill valve 202 remains open, in which case, although pump plunger 206 slides up and down as long as first cam 210 continues to rotate (along with rotation of the engine), the fuel is not pressurized because electromagnetic spill valve 202 does not close.

The pressurized fuel presses and opens check valve 204 provided with the leakage function (of the set pressure of about 60 kPa), and the fuel is delivered via first high-pressure delivery connection pipe 500 to high-pressure delivery pipe 112. At this time, the fuel pressure is controlled in a feedback manner by a fuel pressure sensor provided at high-pressure delivery pipe 112. High-pressure delivery pipes 112 at the respective banks are connected via high-pressure connection pipe 520, as described above.

Check valve 204 with the leakage function is a check valve of a normal type but provided with pores that are always open. When the fuel pressure within first high-pressure fuel pump 200 (pump plunger 206) becomes lower than the fuel pressure within first high-pressure delivery connection pipe 500 (for example, when the engine and hence cam 210 stops while electromagnetic spill valve 202 remains open), the high-pressure fuel within first high-pressure delivery connection pipe 500 returns through the pores back to the high-pressure fuel pump 200 side, thereby lowering the fuel pressure within high-pressure delivery connection pipe 500 as well as within high-pressure delivery pipe 112. As such, at the time of stop of the engine, for example, the fuel within high-pressure delivery pipe 112 is not at a high pressure, so that leakage of the fuel from in-cylinder injectors 110 is prevented.

The controlled variable for use in feedback control of high-pressure fuel pump 200 is calculated based on an integral term that is updated in accordance with a difference between an actual fuel pressure and a target value thereof, a proportional term that is increased or decreased so as to make the difference between the actual fuel pressure and its target value become "zero", and others. If the controlled variable increases, the amount of the fuel discharged from high-pressure fuel pump 200 increases, resulting in an increase of the fuel pressure. If the controlled variable decreases, the amount of the fuel discharged from high-pressure fuel pump 200 decreases, resulting in a decrease of the fuel pressure.

If the actual fuel pressure becomes excessively higher than the target value, both the integral term and the proportional term are reduced so as to lower the actual fuel pressure to the target value. However, since it takes time to lower the fuel pressure, the integral term will become excessively small while the actual fuel pressure is being lowered to the target value. If the integral term becomes too small, the fuel pressure will not be maintained at the target value after the actual fuel pressure reaches the target value, resulting in further reduction of the fuel pressure to cause so-called "undershoot".

More specifically, the engine ECU drives in-cylinder injectors 110 in a controlled manner based on a final fuel injection amount so as to control the amount of the fuel injected from in-cylinder injectors 110. The amount of the fuel injected from in-cylinder injectors 110 (i.e., fuel injection amount) is decided in accordance with the pressure of the fuel (i.e., fuel pressure) within high-pressure delivery pipe 112 and the time period during which the fuel is injected. In order to attain a proper fuel injection amount, it is necessary to maintain the fuel pressure at a proper level. Thus, the engine ECU controls the amount of the fuel discharged from high-pressure fuel pump 200 in a feedback manner to keep a fuel pressure P at a proper value such that the fuel pressure obtained based on a detection signal from a fuel pressure sensor approaches a target fuel pressure P(0) that is set in accordance with the engine operation state. The amount of the fuel discharged from high-pressure fuel pump 200 is controlled in a feedback manner by adjusting the valve closing duration (i.e., valve closing start timing) of the electromagnetic spill valve based on a duty ratio DT, as described above.

Here, the duty ratio DT is explained. Duty ratio DT is a controlled variable that is used for controlling the amount of the fuel discharged from high-pressure fuel pump 200 (i.e., valve closing start timing of electromagnetic spill valve 202). Duty ratio DT changes within the range of 0% to 100%, and is related to a cam angle of cam 21 that corresponds to the valve closing duration of electromagnetic spill valve 202. More specifically, when the cam angle corresponding to the maximum valve closing duration of electromagnetic spill valve 202 (maximum cam angle) is represented by "θ (0)" and the cam angle corresponding to a target value of the valve closing duration (target cam angle) is represented by "θ", then duty ratio DT indicates the proportion of target cam angle θ with respect to the maximum cam angle θ (0). Accordingly, duty ratio DT is set to a value closer to 100% as the target valve closing duration (valve closing start timing) of electromagnetic spill valve 202 becomes closer to the maximum valve closing duration. As the target valve closing duration becomes closer to "0", duty ratio DT is set to a value closer to 0%.

As duty ratio DT approaches 100%, the valve closing start timing of electromagnetic spill valve 202 adjusted based on duty ratio DT is advanced, and the valve closing duration of electromagnetic spill valve 202 is elongated. As a result, the amount of the fuel discharged from high-pressure fuel pump 200 increases, resulting in an increase of fuel pressure P. As duty ratio DT approaches 0%, the valve closing start timing of electromagnetic spill valve 202 adjusted based on duty ratio DT is delayed, and the valve closing duration of electromagnetic spill valve 202 is shortened. As a result, the amount of the fuel discharged from high-pressure fuel pump 200 decreases, resulting in a decrease of fuel pressure P.

Hereinafter, a procedure of calculating duty ratio DT is explained. Duty ratio DT is calculated based on the following expression (1).

$$DT=FF+DTp+DTi+\alpha \quad (1)$$

where FF is a feed-forward term, DTp is a proportional term, and DTi is an integral term. α is a correction term for taking into account the leakage amount of the fuel from check valve 204 provided with the leakage function. In the expression (1), feed-forward term FF is for supplying in advance the fuel of an amount comparable to the required fuel injection amount to high-pressure delivery pipe 112, so as to make fuel pressure P quickly approach target fuel pressure P(0) even during the transition state of the engine. Proportional term DTp is for causing fuel pressure P to approach target fuel pressure P(0), and integral term DTi is for suppressing variation in duty ratio DT attributable to fuel leakage, individual difference of high-pressure fuel pump 200, and others.

The engine ECU controls the timing at which the electromagnetic solenoid of electromagnetic spill valve 202 is started to be electrified, that is, the valve closing start timing of electromagnetic spill valve 202, based on duty ratio DT calculated using the expression (1). With the valve closing start timing of electromagnetic spill valve 202 thus controlled, the valve closing duration of electromagnetic spill valve 202 changes to adjust the amount of the fuel discharged from high-pressure fuel pump 200, so that fuel pressure P changes to approach target fuel pressure P(0).

Feed-forward term FF is calculated based on the engine operation state such as the final amount of fuel injection, engine speed NE and the like. Feed-forward term FF increases with the increase of the required fuel injection amount, and causes duty ratio DT to change to become closer to 100%, i.e., to change to the side increasing the amount of the fuel discharged from high-pressure fuel pump 200.

Proportional term DTp is calculated based on the actual fuel pressure P and the preset target fuel pressure P(0), in accordance with the following expression (2).

$$DTp=K(1)\cdot(P(0)-P) \quad (2)$$

where K(1) is a coefficient, P is an actual fuel pressure, and P(0) is a target fuel pressure. As seen from the expression (2), in the case where actual fuel pressure P is smaller than target fuel pressure P(0), proportional term DTp takes a greater value as their difference (P(0)−P) increases, and causes duty ratio DT to become closer to 100%, i.e., to change to the side increasing the amount of the fuel discharged from high-pressure fuel pump 200. As the difference (P(0)−P) decreases with actual fuel pressure P approaching target fuel pressure P(0), proportional term DTp takes a smaller value, and causes duty ratio DT to become closer to 0%, i.e., to change to the side decreasing the amount of the fuel discharged from high-pressure fuel pump 200.

Integral term DTi is calculated based on the integral term DTi obtained in a previous cycle, actual fuel pressure P and target fuel pressure P(0), in accordance with the following expression (3), for example.

$$DTi=DTi+K(2)\cdot(P(0)-P) \quad (3)$$

where K(2) is a coefficient, P is an actual fuel pressure, and P(0) is a target fuel pressure. As seen from the expression (3), while actual fuel pressure P is smaller than target fuel pressure P(0), the value corresponding to their difference (P(0)−P) is added to integral term DTi at every prescribed cycle. As a result, integral term DTi is gradually updated to a greater value, to cause duty ratio DT to become gradually closer to 100% (to change to the side increasing the amount of the fuel discharged from high-pressure fuel pump 200). On the other hand, while fuel pressure P is greater than target fuel pressure P(0), the value corresponding to their difference (P(0)−P) is subtracted from integral term DTi at every prescribed cycle. As a result, integral term DTi is gradually updated to a smaller value, to cause duty ratio DT to become gradually closer to 0% (to change to the side decreasing the amount of the fuel discharged from high-pressure fuel pump 200). It is noted that integral term DTi has an initial value of 0.

Figure 3:
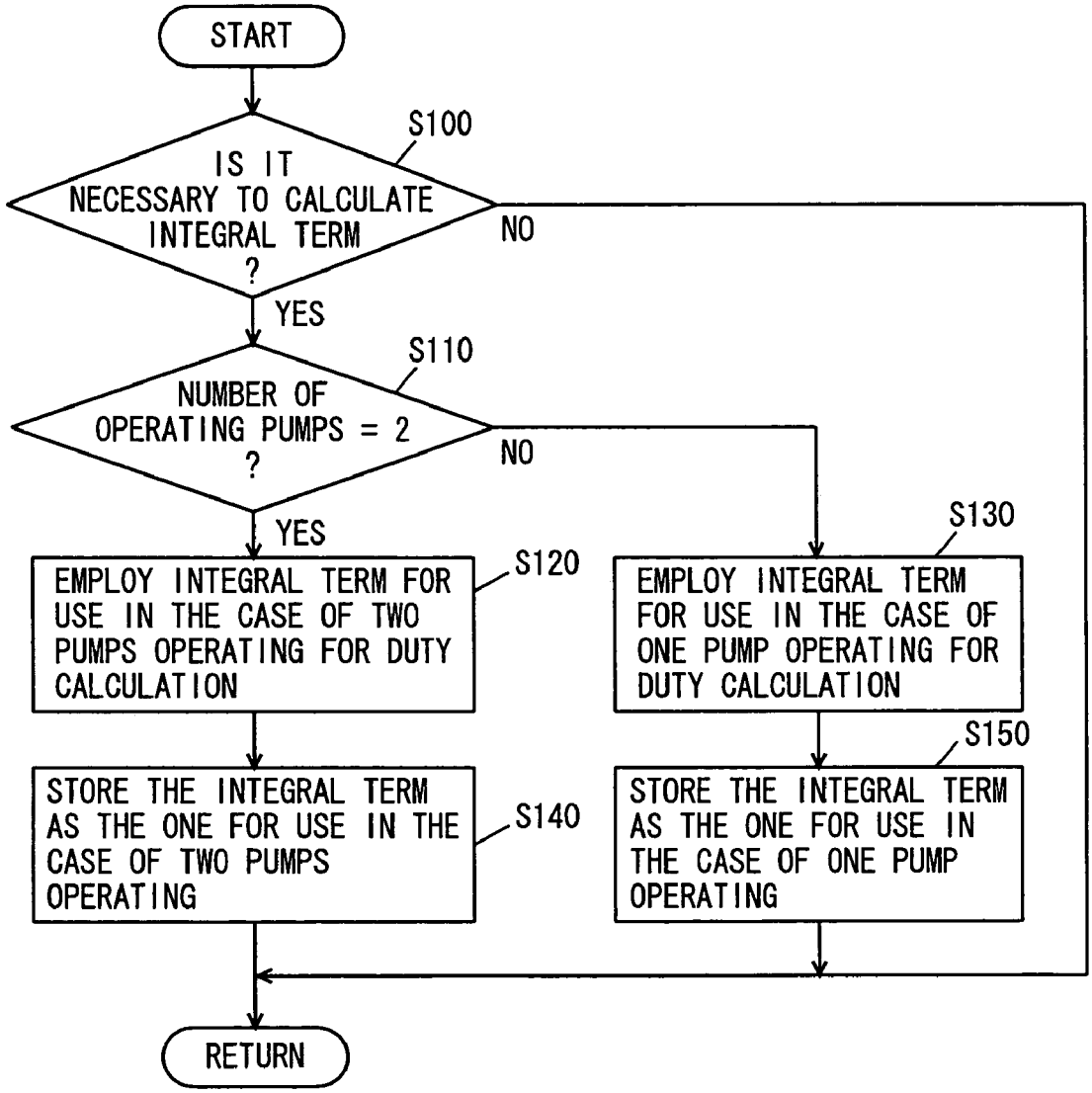
FIG. 3 is a flowchart illustrating a control structure of a program executed by an engine ECU.

Hereinafter, a control structure of a program executed by an engine ECU implementing the control device of the present embodiment will be described with reference to FIG. 3.

In step (hereinafter, abbreviated as "S") 100, the engine ECU determines whether it is necessary to calculate an integral term for use in feedback control. For example, it is determined that it is unnecessary to calculate the integral term when control duty is 100%. If it is necessary to calculate the integral term (YES in S100), the process goes to S110. If not (NO in S100), the process is terminated.

In S110, the engine ECU determines whether the number of operating pumps is 2. If the number of operating pumps is 2 (YES in S110), the process goes to S120. If not (NO in S110), the process goes to S130.

In S120, the engine ECU employs an integral term for use in the case of two pumps operating, to calculate a duty. In S130, the engine ECU employs an integral term for use in the case of one pump operating, to calculate a duty.

In S140, the engine ECU stores the integral term as the one for use in the case of two pumps operating, in a memory within the engine ECU. In S150 the engine ECU stores, in the memory therein, the integral term as the one for use in the case of one pump operating.

In the process in each of S140 and S150, the integral term is temporarily stored in the memory repeatedly, since the integral term is calculated based on the integral term having been obtained in the previous operation cycle (see the expression (3)).

An operation of the high-pressure fuel system controlled by the engine ECU implementing the control device of the present embodiment based on the above-described structure and flowchart will now be explained.

When it is determined that it is necessary to calculate the integral term (YES in S100), if the number of operating pumps is 2 (YES in S110), the integral term for use in the case of two pumps operating is employed to calculate a duty (S120), and the calculated integral term is stored in the memory as the one for use in the case of two pumps operating (S140).

If the number of operating pumps is not 2 (NO in S110), it means that only one pump is operating. Thus, the integral term for use in the case of one pump operating is employed to calculate a duty (S130), and the calculated integral term is stored in the memory as the one for use in the case of one pump operating (S150).

Figure 4:
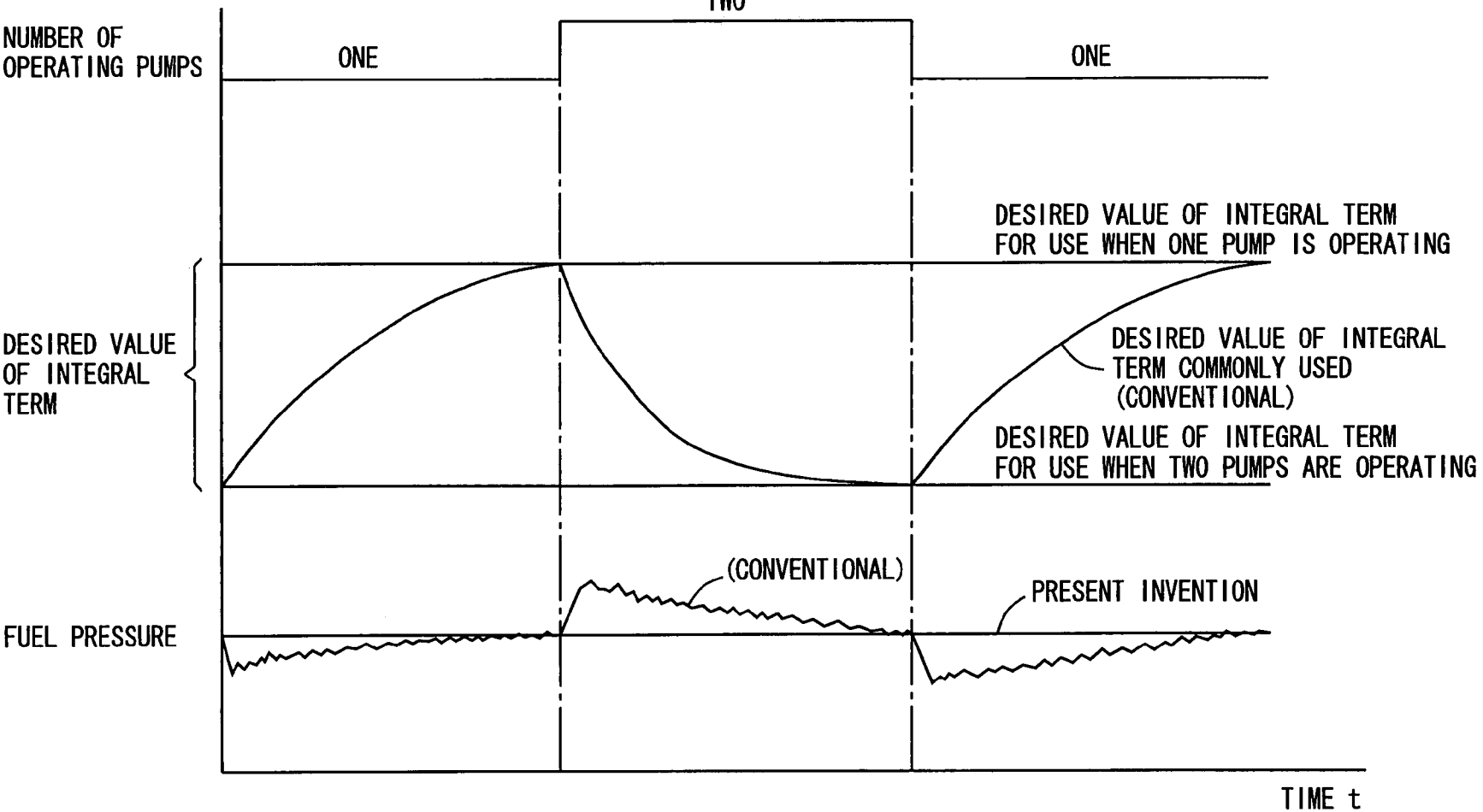
FIG. 4 shows control states as a result of execution of the program by the engine ECU.

FIG. 4 illustrates the difference between the present invention where two desired values of integral term are set, one for use when one pump is operating and the other for use when two pumps are operating, and the conventional method where one desired value of integral term is set to be commonly used when one or two pumps are operating.

FIG. 4 shows changes of fuel pressures when the number of operating pumps is changed from one to two and two to one, with the horizontal axis representing time. Conventionally, a desired value of integral term to be commonly used irrespective of the number of operating pumps was set, as shown by a curve in the middle of FIG. 4. In contrast, in the present invention, a desired value of integral term for use when one pump is operating and a desired value of integral term for use when two pumps are operating are set separately, and the desired value of integral term employed is switched from the one for use in the case of one pump operating to the one for use in the case of two pumps operating as the number of operating pumps is changed from one to two, and switched from the one for use in the case of two pumps operating to the one for use in the case of one pump operating as the number of operating pumps is changed from two to one.

Therefore, compared to the conventional case where the fuel pressure was deviated largely from its target value when the number of operating pumps was changed from one to two or two to one and was then controlled to gradually reduce the deviation, the present invention can suppress fluctuation of the fuel pressure. As such, the steady-state error is eliminated, and therefore, controllability is significantly improved.

As described above, according to the high-pressure fuel system controlled by the engine ECU implementing the control device of the present embodiment, the desired value (or, setting) of the integral term is changed according to whether one or two pumps are operating, and accordingly, good controllability of the fuel pressure is ensured.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel pressure control device of an internal combustion engine having a first fuel pump and a second fuel pump each discharging a fuel into a fuel pipe, the fuel pressure control device controlling an amount of the fuel discharged from said first fuel pump and an amount of the fuel discharged from said second fuel pump in a feedback manner based on an actual fuel pressure in said fuel pipe and a target value thereof such that the actual fuel pressure approaches the target value, comprising:

a calculating unit for calculating a controlled variable used for the feedback control of the amounts of the fuel discharged from said fuel pumps based on an integral term that is updated in accordance with a difference between said actual fuel pressure and the target value thereof; and a changing unit for changing setting of said integral term between the case where one of said first and second fuel pumps is operating and the case where both of said first and second fuel pumps are operating.

2. A fuel pressure control device of an internal combustion engine having at least two fuel pumps discharging a fuel into a fuel pipe, the fuel pressure control device controlling amounts of the fuel discharged from said fuel pumps in a feedback manner based on an actual fuel pressure in said fuel pipe and a target value thereof such that the actual fuel pressure approaches the target value, comprising:

a calculating unit for calculating a controlled variable used for the feedback control of the amounts of the fuel discharged from said fuel pumps based on an integral term that is updated in accordance with a difference between said actual fuel pressure and the target value thereof; and a changing unit for changing setting of said integral term based on the number of operating pumps among said fuel pumps.

3. A fuel pressure control device of an internal combustion engine having at least two fuel pumps discharging a fuel into a fuel pipe, the fuel pressure control device controlling amounts of the fuel discharged from said fuel pumps in a feedback manner based on an actual fuel pressure in said fuel pipe and a target value thereof such that the actual fuel pressure approaches the target value, comprising:

calculating means for calculating a controlled variable used for the feedback control of the amounts of the fuel discharged from said fuel pumps based on an integral term that is updated in accordance with a difference between said actual fuel pressure and the target value thereof, and changing means for changing setting of said integral term based on the number of operating pumps among said fuel pumps.

4. A fuel pressure control device of an internal combustion engine having a first fuel pump and a second fuel pump each discharging a fuel into a fuel pipe, the fuel pressure control device controlling an amount of the fuel discharged from said first fuel pump and an amount of the fuel discharged from said second fuel pump in a feedback manner based on an actual fuel pressure in said fuel pipe and a target value thereof such that the actual fuel pressure approaches the target value, comprising:

calculating means for calculating a controlled variable used for the feedback control of the amounts of the fuel discharged from said fuel pumps based on an integral term that is updated in accordance with a difference between said actual fuel pressure and the target value thereof; and changing means for changing setting of said integral term between the case where one of said first and second fuel pumps is operating and the case where both of said first and second fuel pumps are operating.

* * * * *